US007748061B2

(12) United States Patent
Pine

(10) Patent No.: US 7,748,061 B2
(45) Date of Patent: Jul. 6, 2010

(54) SLEEP SOFA WHEREIN SEAT AND BACK CUSHIONS PROVIDE BEDDING SURFACE

(75) Inventor: James J. Pine, Tupelo, MS (US)

(73) Assignee: JPD, Inc., Tupelo, MS (US)

( * ) Notice: Subject to any disclaimer, the term of this patent is extended or adjusted under 35 U.S.C. 154(b) by 31 days.

(21) Appl. No.: 12/222,182

(22) Filed: Aug. 4, 2008

(65) Prior Publication Data

US 2009/0031494 A1 Feb. 5, 2009

Related U.S. Application Data

(60) Provisional application No. 60/935,246, filed on Aug. 2, 2007.

(51) Int. Cl.
*A47C 17/17* (2006.01)

(52) U.S. Cl. ..... 5/43; 5/45; 5/58

(58) Field of Classification Search ..... 5/22, 5/43, 45, 58

See application file for complete search history.

(56) References Cited

U.S. PATENT DOCUMENTS 2,597,995 A * 5/1952 Jenkins ..... 5/45
2,880,426 A * 4/1959 Goldstein ..... 5/37.1
3,800,337 A * 4/1974 Mizelle ..... 5/43
4,625,347 A * 12/1986 McElmurry et al. ..... 5/43
4,639,953 A * 2/1987 McElmurry et al. ..... 5/43

* cited by examiner

*Primary Examiner*—Michael Trettel
(74) *Attorney, Agent, or Firm*—Dykema Gossett PLLC

(57) ABSTRACT

A sleep sofa includes a main frame, a seat unit, a back unit and a supporting linkage assembly that can move the back unit along an arc to the front of the seat unit when the sleep sofa is converted to a bed state, the supporting linkage simultaneously lifting the rear side of the seat unit, which is mounted in the main frame to slope downwardly from horizontal at about a 5° angle, up to horizontal. Once positioned in front of the seat unit, the back unit can be pushed downwardly so as to rotate into a locked parallel orientation with the seat unit. The seat cushion of the seat unit and the back cushion of the back unit form the bedding surface. Pushing a back release tube will unlock the back unit to allow it to be returned to a sitting positioning above the seat unit (tilted rearwardly to define an angle of about 115° with the seat unit). During its arc movement over the seat unit, the back unit will rotate around pivots on the side backs thereof.

12 Claims, 9 Drawing Sheets

SLEEP SOFA WHEREIN SEAT AND BACK CUSHIONS PROVIDE BEDDING SURFACE

CROSS-REFERENCE TO RELATED APPLICATION

This application is based on U.S. Provisional Application No. 60/935,246, filed Aug. 2, 2007, the priority of which is hereby claimed.

BACKGROUND OF INVENTION

1. Field of the Invention

This invention relates to sleep sofas, also known as sofa-sleepers, convertible sofas and convertible couches, which in normal use can look and function as a sofa or couch, but which can be manually transformed into a bed, and vice versa, thus displaying a dual functionality.

2. The Prior Art

Sleep sofas are a well-known classification of furniture and have been marketed for over 50 years. With conventional sleep sofas the folded mattress is stored under the seat cushions, and when the sleep sofa is converted from a sitting state to a bed state, furniture in front of the sofa (such as a coffee table) is first moved away, the back and seat cushions of the sofa are then removed, and the folded mattress stored in the bottom of the sofa under the seat cushions is lifted upwardly and forwardly of the sofa frame and unfolded into the bedding surface by a support linkage. Unfortunately, the mattresses are known to be hard and uncomfortable insofar as they are mechanically compressed for long periods of time when folded in a stored state in the sofa, thus losing their softness when unfolded, and when forming a underlying support for the seat cushions (when the sofa is in a sitting state), the folded mattress provides a rock solid (uncomfortable) support surface. In addition, these sleep sofas are very heavy, and in order to contain a mattress of desired full size, their frames are too large to easily fit through standard size doorways.

Alternative constructions of convertible sofas are known wherein the back unit (with back cushion) is relocated from a sitting position above the seat cushion to a position in front of the seat cushion (bed state). For example, the back unit can be simply pivoted forwardly (see U.S. Pat. No. 6,918,143) or caused to rotate as it is moved forwardly over the seat unit (see U.S. Pat. No. 3,809,337). However, none of these known constructions provide both a comfortable sofa and comfortable bed.

It is an object of this invention to provide a sleep sofa which does not house a separate mattress, but wherein its cushions provide its bedding surface.

It is another object of this invention to provide a sleep sofa which, when in its bed state, will provide a bedding surface of standard full size, but when in its sitting state can easily fit through a standard 36" doorway.

It is another object of this invention to provide a sleep sofa which can include a front-access storage drawer unit beneath the seat unit.

It is another object of this invention to provide a sleep sofa which can be converted from a sitting state to a bedding state without the need to first remove furniture (such as a coffee table) from in front of the sofa.

It is another object of this invention to provide a sleep sofa wherein the seat unit is oriented at a comfortable rearwardly declining angle to horizontal when the sleep sofa is in a sitting state, but which is lifted to generally horizontal when the sleep sofa is converted to a bed state.

It is another object of this invention to provide a sleep sofa wherein the back unit, when the sleep sofa is in a sitting state, will be located above the seat cushion and at a rearward tilt, and at an angle of about 105° to the seat unit.

It is another object of this invention to provide a sleep sofa wherein the seat and back cushions can be "tight cushion" permanently upholstered (attached) to their associated supporting frames to provide uniform sitting and sleeping comfort to the user and cost savings for the manufacturer.

It is another object of this invention to provide a sleep sofa wherein the support linkage therein is below and behind the seat and back surfaces when the sleep sofa is in a sitting state, thus preventing injury to users.

It is another object of this invention to provide a sleep sofa wherein the support linkage allows the back to be upholstered and finished with attached side cushion "pillows" which finish the sofa and cover the support linkage therein when the sleep sofa is in a sitting state.

SUMMARY OF THE INVENTION

These and other objects are achieved in a sleep sofa which includes a main frame, a seat unit, a back unit, and an internal supporting linkage assembly that is connected to the main frame and the back unit to move the back unit along an arc between a sitting positioning above a rear part of the seat unit and a bed positioning in front of the seat unit, such that the seat cushion of the seat unit and the seat cushion of the back unit will provide the bedding surface when the sleep sofa is converted to a bed state. During its travel between a sitting positioning and a bed positioning, the back unit will not rotate more than 180°. The seat unit is mounted in the main frame so as to extend downwardly from a front side to a rear side at a declining angle of about 5° to horizontal when the sleep sofa is in a sitting state, and the supporting linkage assembly will lift the seat unit to horizontal as the sleep sofa is converted to a bed state. The supporting linkage assembly will cause the back unit, when the sleep sofa is in a sitting state, to be located above the seat unit and rearwardly tilted to define an enclosed angle of about 105°. The supporting linkage assembly includes mirror-image right and left linkage subassemblies interconnected by a torque tube, each subassembly including a four-bar motion linkage for moving the back unit between a sitting position above the seat unit and a position in front of the seat unit, and a back unit support subassembly for manually rotating the back unit, once positioned in front of the seat unit, into a locked bed positioning in parallel with the seat unit. A back release tube extends between the back unit support subassemblies of the right and left linkage subassemblies to release the locking of the back unit when it is desired to return the sleep sofa to a sitting state.

Further features and advantages of the invention will become apparent from the attached drawings taken in conjunction with the following discussion.

DETAILED DESCRIPTION OF THE PREFERRED EMBODIMENT

Figure 1:
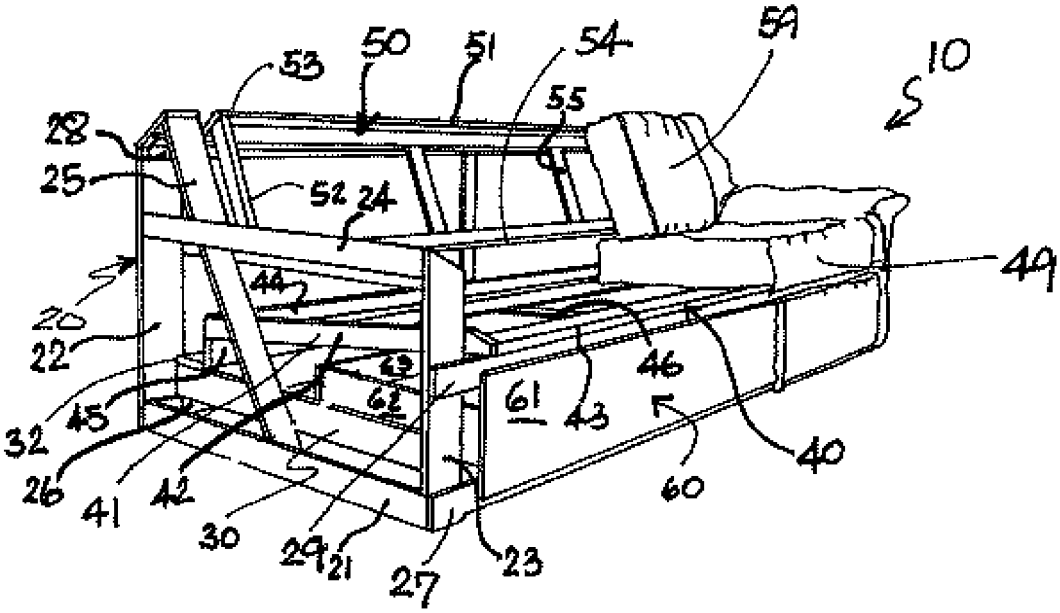
FIG. 1 shows a perspective front view of a sleep sofa according to a preferred embodiment of this invention, its fabric covering, seat cushion and back cushion being partially removed (except at the far left end) to expose the underlying main frame, seat frame and back frame, the support linkage assembly also being omitted for better understanding of the frames and drawer unit therein, FIG. 2*a* schematically shows the back unit relative to the seat unit when the sleep sofa is in a sitting state, the drawer unit being depicted opened and closed relative to a coffee table in front of the sleep sofa.

FIG. 1 shows the inventive sleep sofa, generally labeled 10, as including a main frame 20, a seat unit 40, a back unit 50, and a drawer unit 60 (it also includes a support linkage assembly, not shown).

The main frame 20 includes at its near (right) end a bottom end rail 21 (intended to be positioned horizontally on a flooring surface), a vertical rear member 22, a vertical front member 23, an upper arm rail 24 and an outside back member 25. Corresponding elements to these elements 21-25 are found at the opposite (left) end of the frame (not seen in FIG. 1). A bottom rear rail 26 and a bottom front rail 27 extend between the rear and front ends of the bottom end rails at the opposite ends of the sleep sofa. A top rear rail 28 extends between upper ends of the vertical rear members at the opposite ends of the sleep sofa, and a top front rail 29 extends between the vertical front members at the opposite ends of the sleep sofa and above the bottom front rail 27.

An inside arm rail 30 extends between the vertical rear member 22 and the vertical front member 23 (a corresponding inside arm rail extends between the vertical rear member and its vertical front member at the opposite end of the sofa). A bottom mounting pivot board 31 (see FIG. 3) extends between these inside arm rails. A runner board 32 extends between and is supported by the rear ends of the inside arm rails.

Figure 2A:
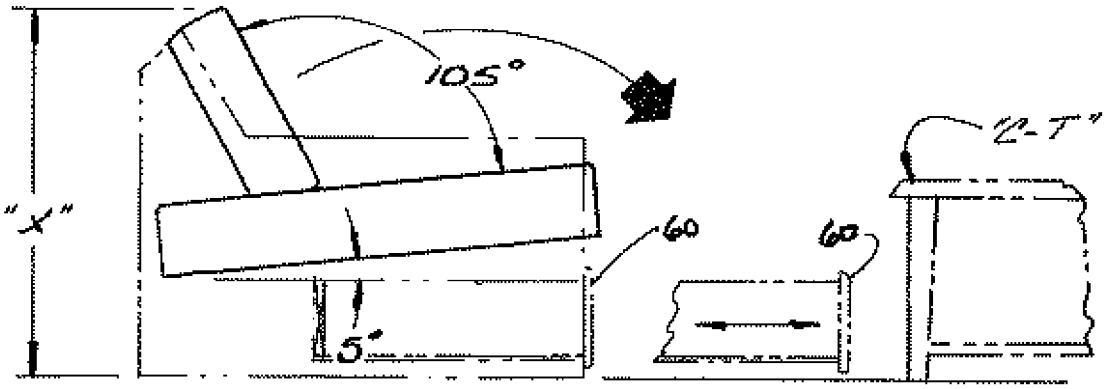
FIG. 2*b* illustrates the positioning of the back cushion in front of and parallel to the seat cushion when the sleep sofa has been converted to a bed state.
Figure 3:
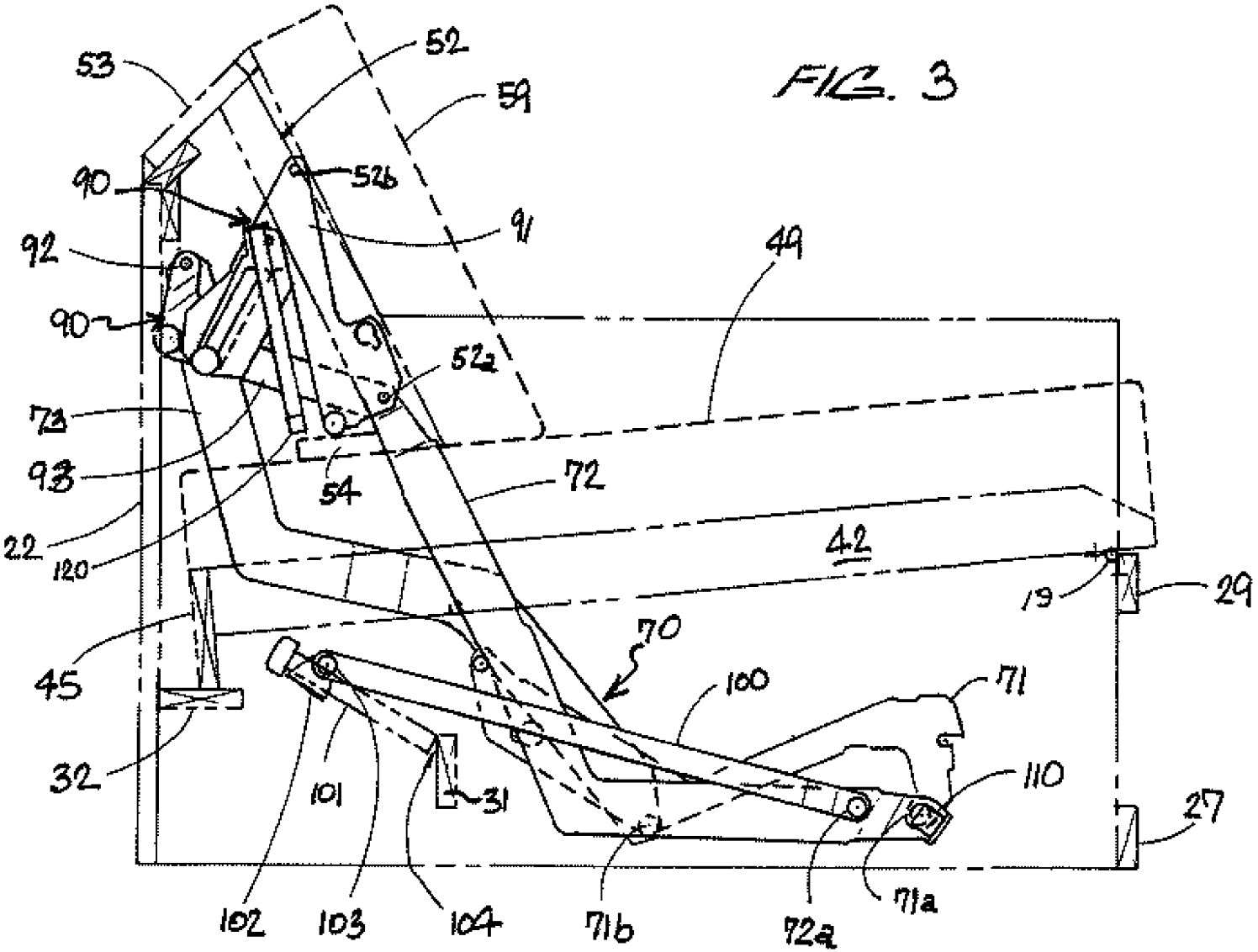
FIG. 3 shows a side view of the right linkage subassembly of the support linkage assembly of the sleep sofa and its relation to elements of the main frame, the seat unit and the back unit when the sleep sofa is in a sitting state.

The seat unit 40 includes a seat frame 41 and a seat cushion 49 positioned thereon. The seat frame includes end rails 42 (only the right end rail is seen in FIG. 1), a front rail 43, a rear rail 44 and a seat back rail 45 which extends downwardly from the rear rail 44. Intermediate cross braces 46 extend between the front and rear rails. As seen in FIG. 3, the front rail is pivotally connected to the top front rail 29 of the main frame by hinges 19. The runner board 32 is positioned at a height lower than the top front rail 29 so that when the seat back rail 45 rests thereon (sleep sofa in sitting state), the seat frame and seat unit as a whole will slope downwardly from the top front rail at an angle of about 5° relative to horizontal (see FIG. 2*a*).

The back unit 50 includes a back frame 51 and a back cushion 59 positioned thereon. The back frame includes side backs 52 (only the right end side back is seen in FIG. 1), top and bottom boards 53 and 54, and intermediate cross braces 55. When the sleep sofa is in a sitting state, the back unit rests on the seat unit and extends upwardly therefrom at a rearward tilt angle of about 105° (see FIG. 2*a*). The tilt angles of the seat unit and back unit provide optimum comfort to a user sitting on the sleep sofa when in a sitting state.

The drawer unit 60 includes a face board 61, side panels 62, a rear panel 63 and a bottom panel. The drawer unit can be positioned within the main frame between the inside arm rails and beneath the seat unit, and pulled out from between the bottom front rail 27 and the top front rail 29 when the sleep sofa is in a sitting state (FIG. 2*a*). The drawer unit provides storage not found in conventional sleep sofas.

Figure 2B:
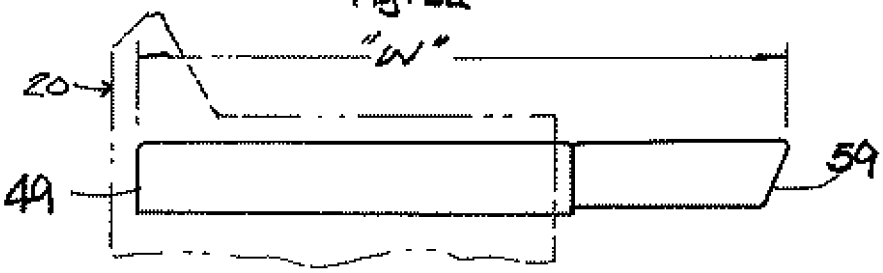

FIG. 2*b* illustrates that when the back cushion is positioned in front of and parallel to the seat cushion when the sleep sofa is in a bed state, the coffee table C-T shown in FIG. 2*a* need not be moved.

FIG. 3 shows a side view of the right linkage subassembly 70 of supporting linkage assembly of the inventive sleep sofa. A mirror-image left linkage subassembly is found on the other side of the sleep sofa, with torque tube 110 and back release tube 120 extending therebetween as will become apparent below.

Figure 9:
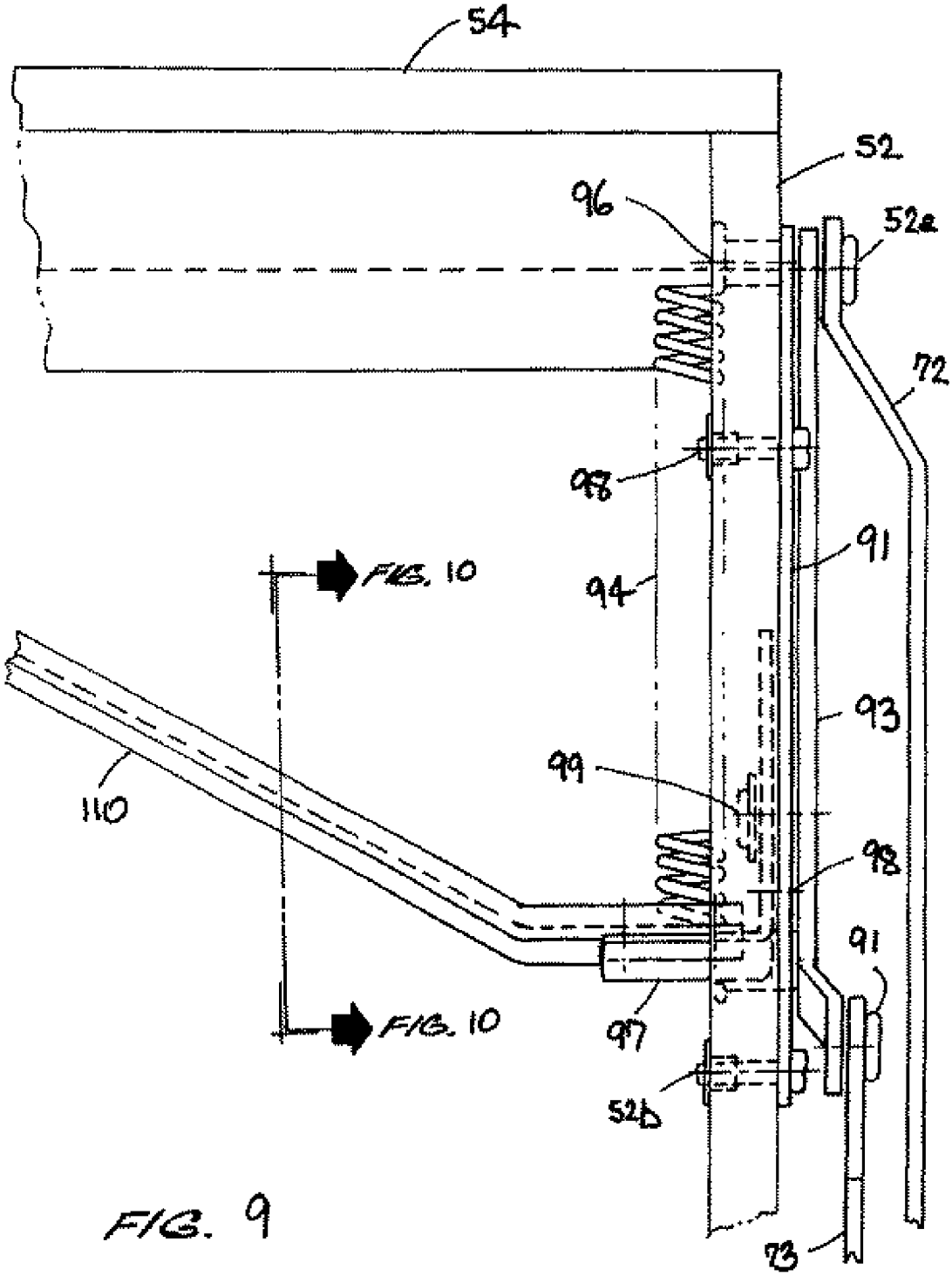
FIG. 9 is a top view of the back unit support subassembly as seen along line 9-9 in FIG. 7.

The right linkage subassembly 70 includes a mounting link 71 which is fixedly attached to an inside surface of the inside arm rail 30 (the surface that faces a side panel 62 of the drawer unit 60), a front link 72 which extends from a first bottom pivot 71*a* on the mounting link to a top pivot 52*a* on the side back 52 of the back frame, and a rear link 73 which extends from a second bottom pivot 71*b* on the mounting link to a top pivot 92 of a top connector link 93 of a back unit support assembly 90. The elements 71, 72, 73 and 93 form a four-bar linkage that controls motion of the back unit from its sitting position above the seat unit to a position in front of the seat unit. The back unit support assembly 90 is shown in more detail in FIGS. 5, 7 and 9.

Figure 4:
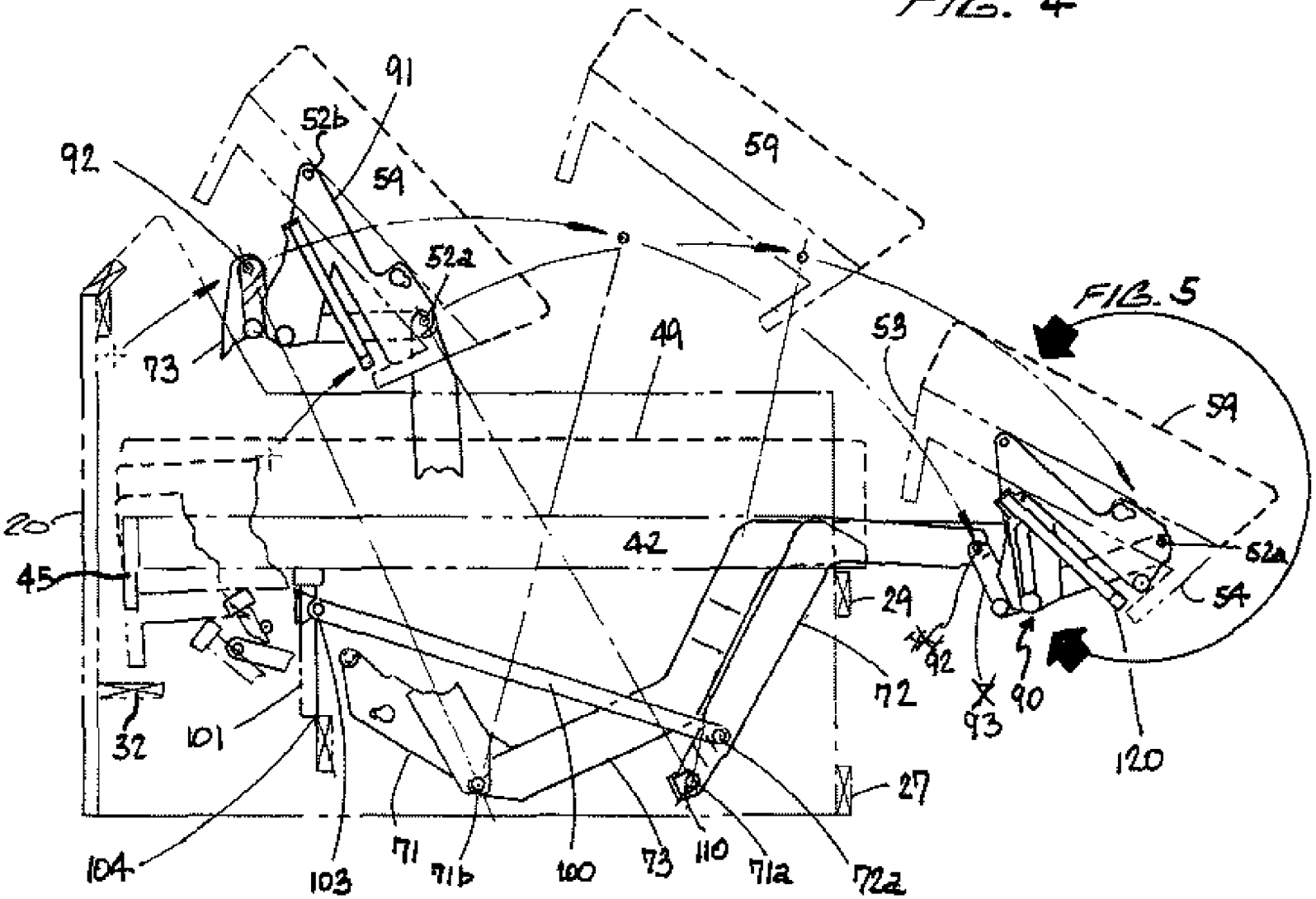
FIG. 4 illustrates the articulation of the elements of the right linkage subassembly and the movement of the back unit and the seat unit as the sleep sofa is converted from a sitting state to a bed state.
Figure 5:
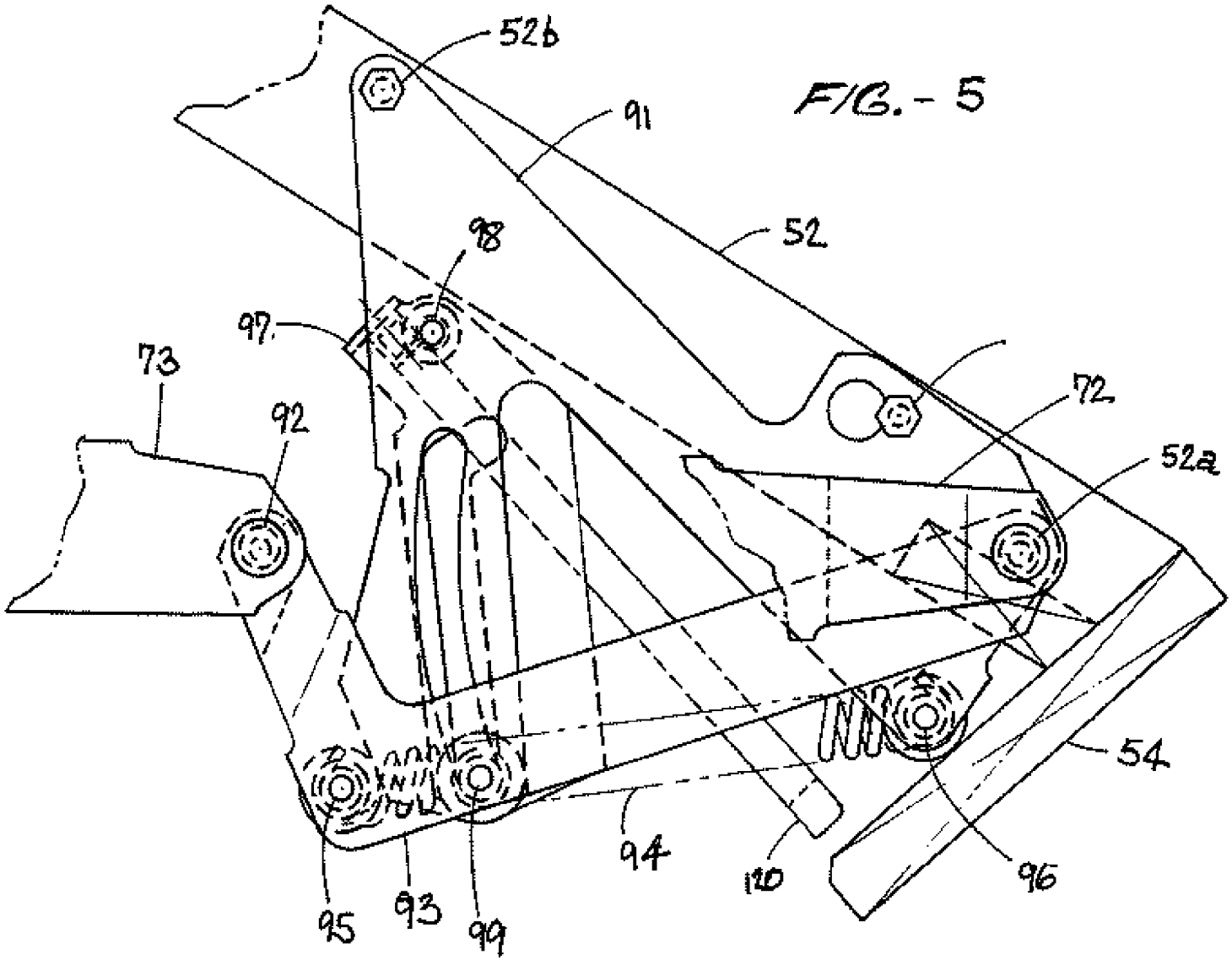
FIG. 5 is a detail of FIG. 4, showing the elements of the back unit support subassembly.
Figure 6:
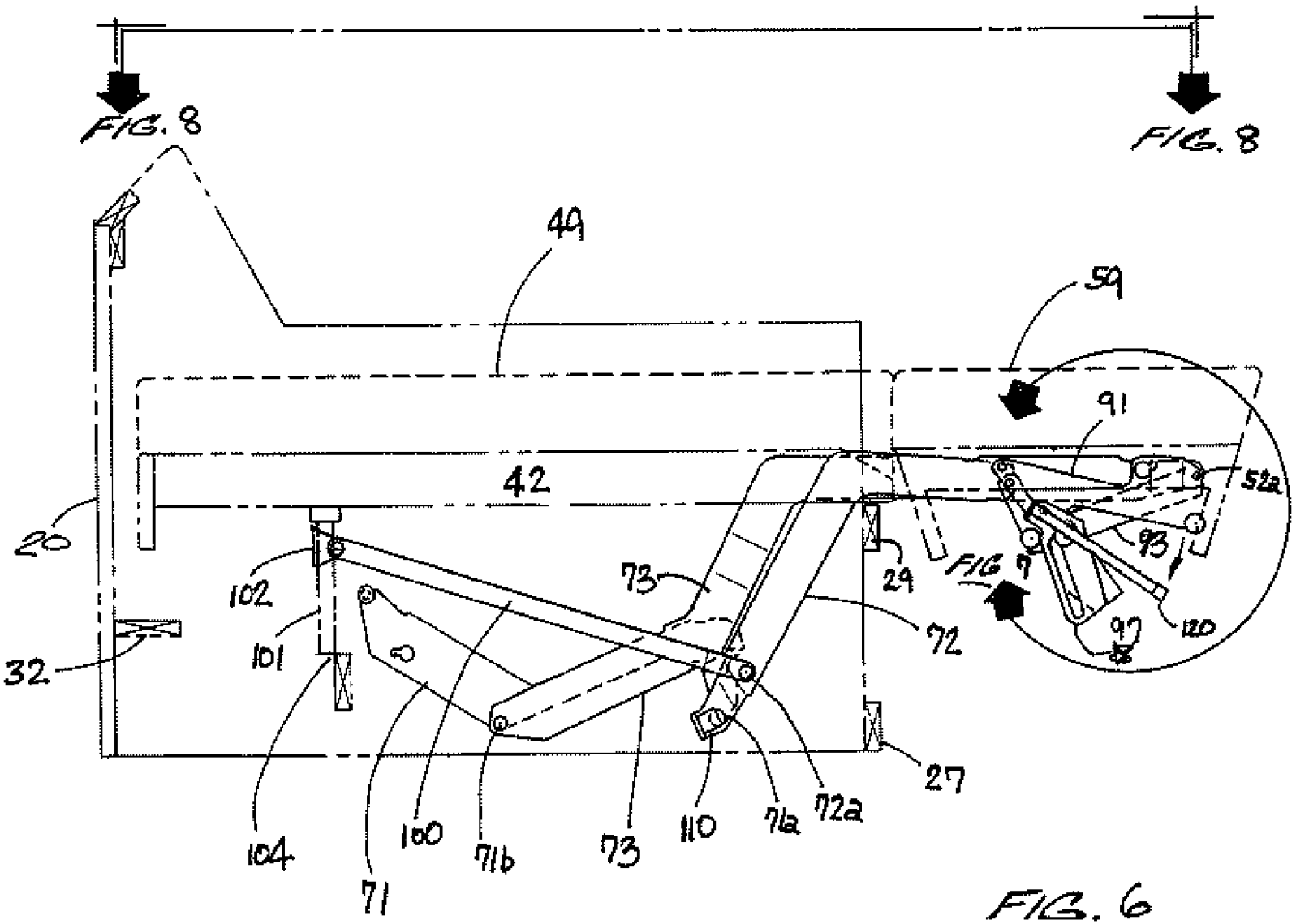
FIG. 6 shows the repositioning orientation of the back unit (parallel with the seat unit) after manual downward force has been applied to the back unit and the back unit support subassembly has been rotated into a locked state.
Figure 7:
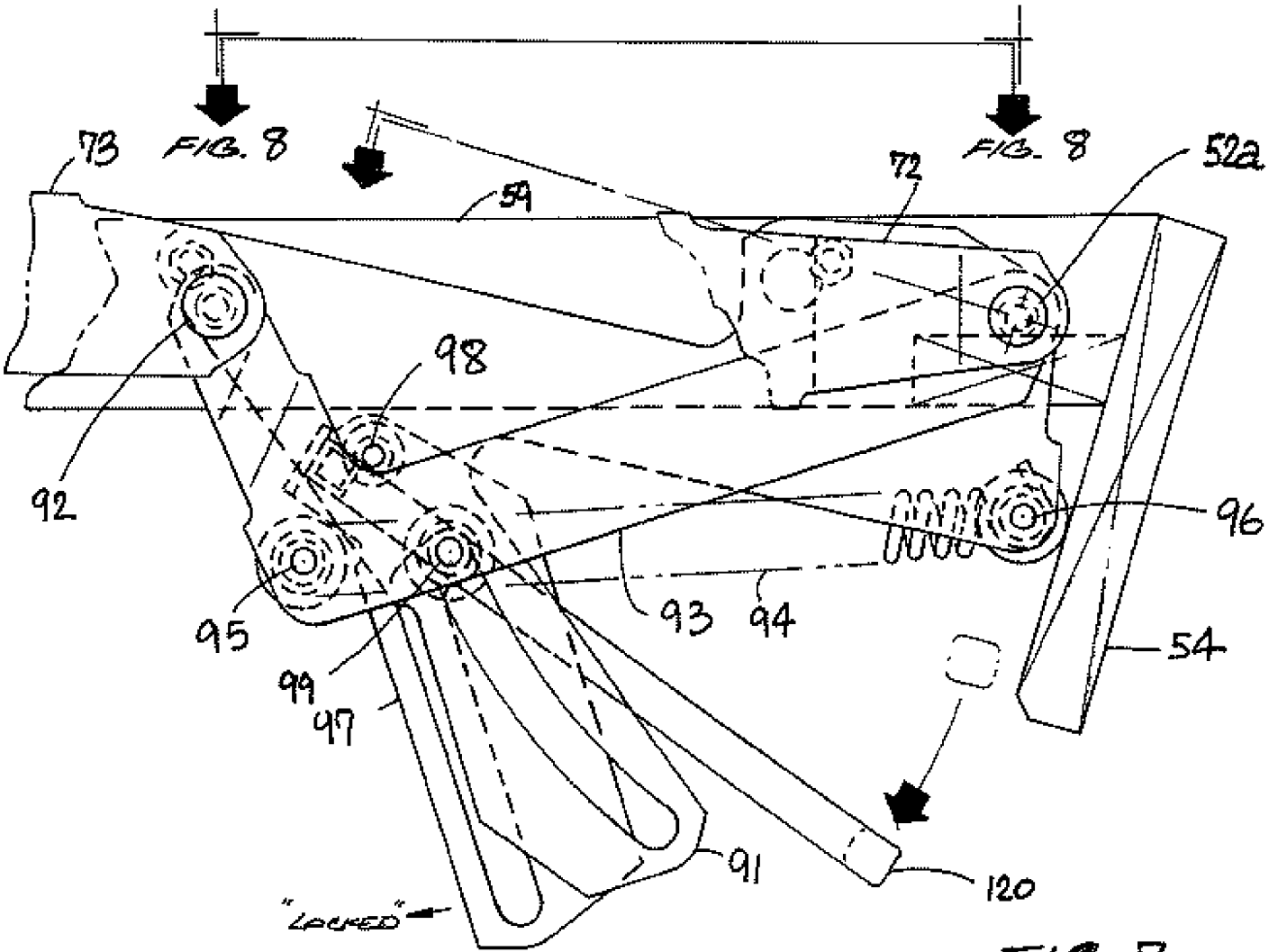
FIG. 7 is a detail of FIG. 6, showing the linkage positioning of the elements of the back unit support subassembly.
Figure 8:
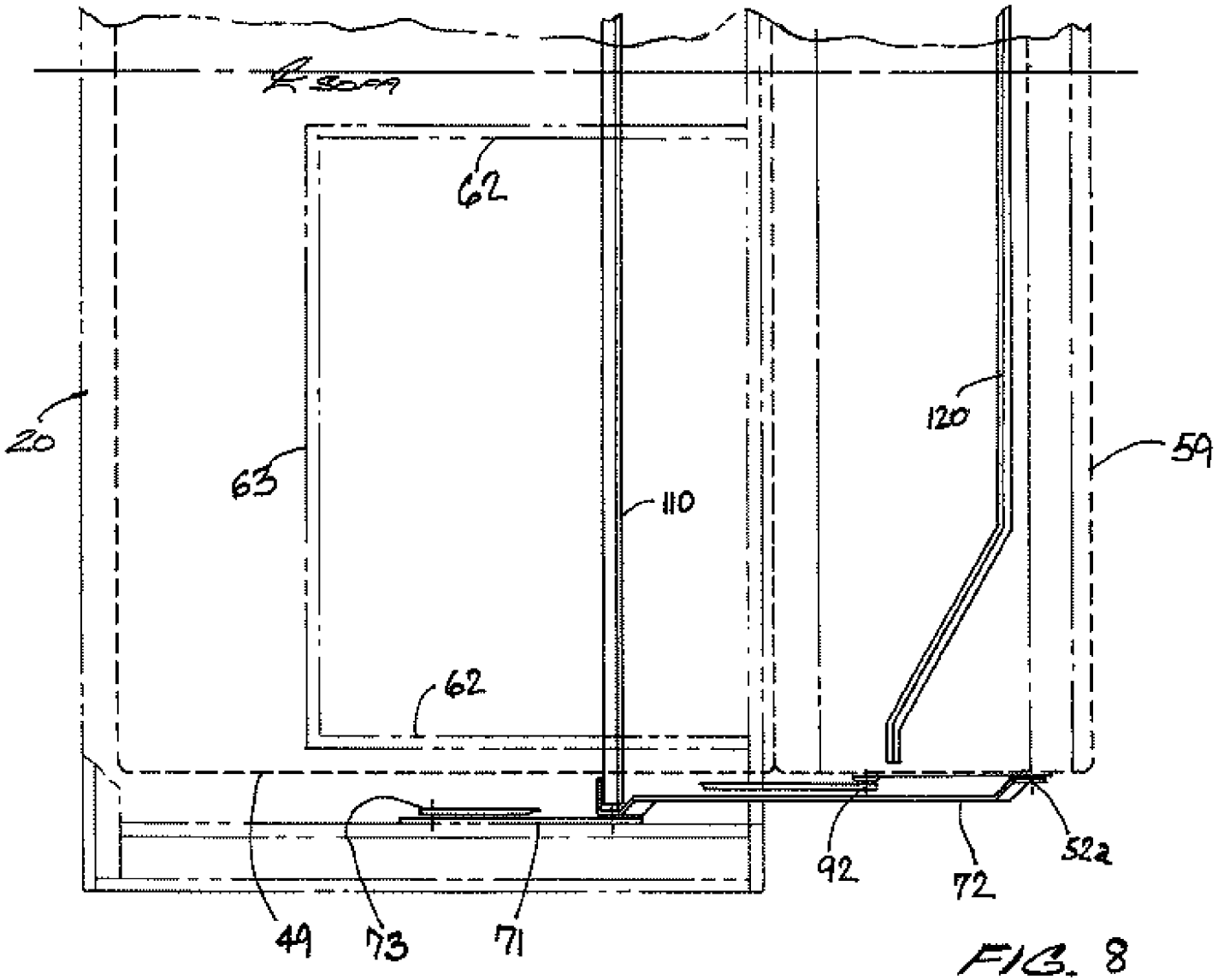
FIG. 8 is a view of certain elements of the support linkage assembly as seen along line 8-8 in FIG. 6.

A connector link 100 extends from a mid pivot 72*a* on the front link 72 to a slider seat lift board 101 which, via a slider board link 102 connected to the end of the connector link at pivot 103, will cause the slider seat lift board 101 to pivot relative to the bottom mounting pivot board 31 via hinges so as to lift the rear side of the seat frame 41 and thus the seat unit 40 to horizontal (bed state). The articulation of the right linkage subassembly 70 (and thus the left linkage subassembly as well) is illustrated in FIGS. 4 and 5. The back unit rotates about pivot 52*a* less than 180° as it moves over and toward the front of the seat unit as the support linkage assembly moves to convert the sleep sofa from a sitting to a bed state. The pivot 52*a* follows a circular arc around pivot 71*a*. The front link 72 and the rear link 73 will ultimately abut the top front rail 29 of the main frame when the back unit is positioned in front of the seat unit. At that point, downward manual pressure on the back cushion 59 will cause the back unit support subassembly to rotate the back unit to rotate around pivot 52*a* into parallel alignment with the seat unit, and the back unit support subassembly 90 articulate into a locked state (FIGS. 6 and 7). Manual operation of the back release tube 120 will unlock the back unit support subassemblies and allow the supporting linkage assembly to move the back unit back to its positioning above the seat unit (sitting state of the sleep sofa).

Figure 10:
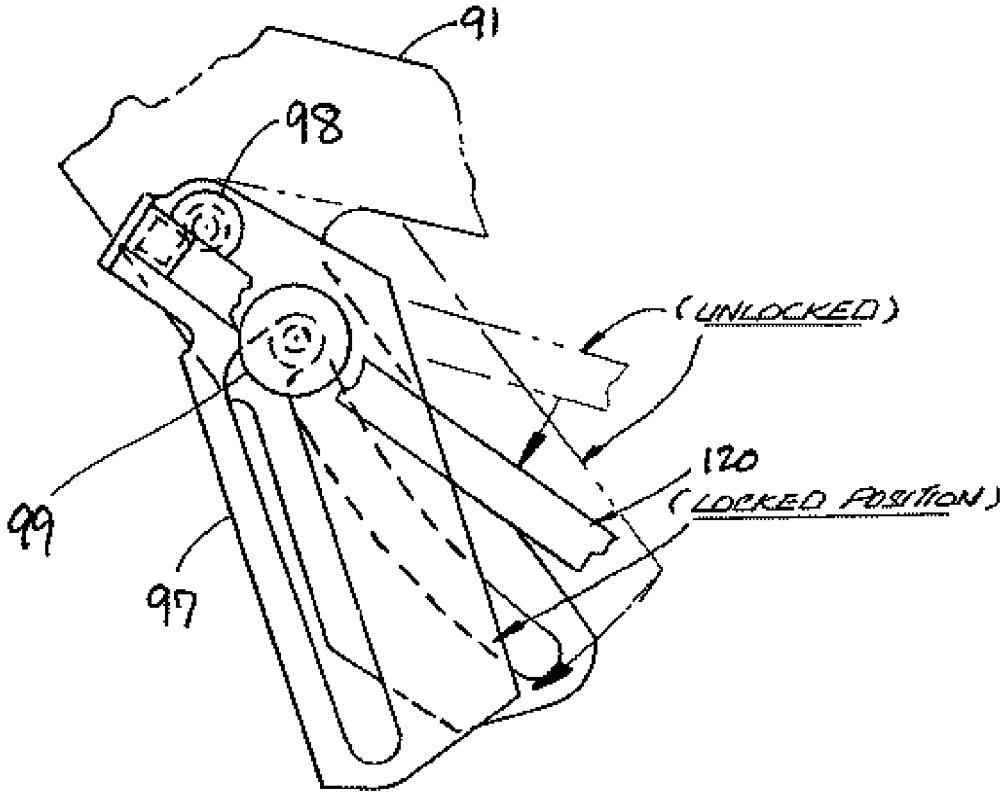
FIG. 10 is a view of the back unit support subassembly as seen along line 10-10 in FIG. 9.

FIG. 5 shows the back unit support assembly 90 as including a back mount link 91, a top connector link 93, a back return spring 94 which extends between connector link spring pin 95 and back link spring pin 96. A back lock link 97 pivots around top pivot 98. As the back unit is pushed downwardly into its bed state, the slot control pin 99 will be relocated such that the back unit support assembly 90 will become locked in the curved slot in back mount link 91 as shown in FIG. 7. Manual operation (rotation) of the back release tube 120 will unlock the support assembly 90. See FIGS. 7 and 10.

While a preferred embodiment of the invention has been shown and described in detail, modifications can be made therein and still fall within the scope of the invention.

I claim:

1. A sleep sofa which comprises:

a main frame for positioning on a flooring surface, a seat unit which includes a seat frame and a seat cushion, the seat frame being pivotally connected along a front side thereof to a fixed pivot on said main frame and liftable to horizontal from a sitting state wherein it slopes downwardly from said front side relative to horizontal, a back unit which includes a back frame and a back cushion, and a support linkage assembly which is connected to said main frame and to said back frame and operable to move said back unit between a sitting position above said seat unit and a bed position in front of said seat unit, said support linkage assembly moving said back unit in an arc over said seat unit to the front of the seat unit, where it can be manually rotated to become part of a bedding surface with the seat cushion, said support linkage assembly simultaneously lifting said seat unit about said fixed pivot on said main frame to generally horizontal when said back unit moves from a sitting state to a bed state.

2. The sleep sofa of a claim 1, wherein said support linkage assembly includes a right linkage subassembly that includes a mounting link attached to said main frame, a front link pivotally connected between a first pivot on said mounting link and a pivot on said back frame, a connector link, a rear link pivotally connected between a second pivot on said mounting link and to one end of said connector link, an opposite end of said connector link pivotally connected to said pivot on said back frame, said mounting link, said front and rear links and said connector link forming a four bar linkage to move said back unit between said sitting and bed positions.

3. The sleep sofa of claim 2, wherein said back frame of said back unit includes right and left side backs connected by top and bottom boards, and wherein said pivot on said back frame is located on said right side back.

4. The sleep sofa of claim 3, wherein said support linkage assembly includes a left linkage subassembly which is a mirror-image of said right linkage subassembly, said left linkage subassembly being pivotally attached to said left side back of said back unit.

5. The sleep sofa of claim 4, wherein said main frame includes at each end a bottom end rail, vertical front and rear members, front and rear bottom rails extending between the bottom end rails, and front and rear top rails extending between the front and rear vertical members, said front and rear links of said four bar linkage resting on said front top rail when said back unit is in said bedding position in front of the seat unit.

6. The sleep sofa of claim 5, wherein said main frame includes right and left inside arm rails which extend between said front and rear bottom rails, and wherein the mounting bracket of each of said four bar linkages is fixedly attached to an inside face of a respective inside arm rail.

7. The sleep sofa of claim 6, wherein said seat frame includes right and left end rails and front and rear rails, and wherein said front rail is hinged to said front top rail of said main frame.

8. The sleep sofa of claim 7, including a runner board which extends between the right and left inside arm rails to provide a support for the rear rail of said seat frame.

9. The sleep sofa of claim 8, including a bottom mounting pivot board extending between said right and left inside arm rails, a slider seat lift board pivotally attached to said bottom mounting pivot board, and a connector link pivotally attached to said front link to cause said slider seat lift board to contact and lift the seat frame to horizontal as said four bar linkage moves said back unit to a positioning in front of said seat unit.

10. The sleep sofa of claim 2, including a torque tube connected between said first pivots of respective mounting links of said right and left linkage subassemblies.

11. The sleep sofa of claim 2, wherein each of the right and left linkage subassemblies includes a back unit support subassembly that enables the back unit to be manually rotated about said pivot thereon to a locked orientation in parallel with said seat unit.

12. The sleep sofa of claim 11, including a back release tube which extends between said back unit support subassemblies which can be manually operated to unlock the back unit support subassemblies and enable the back unit to be returned to its sitting positioning above the seat unit.

* * * * *